US008662831B2

(12) United States Patent
Montgomery

(10) Patent No.: US 8,662,831 B2
(45) Date of Patent: Mar. 4, 2014

(54) DIAPHRAGM SHELL STRUCTURES FOR TURBINE ENGINES

(75) Inventor: Michael E. Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 1105 days.

(21) Appl. No.: 12/646,300

(22) Filed: Dec. 23, 2009

(65) Prior Publication Data

US 2011/0150644 A1 Jun. 23, 2011

(51) Int. Cl.
*F01B 25/00* (2006.01)

(52) U.S. Cl.
USPC ..... 415/145

(58) Field of Classification Search
USPC ..... 415/37, 39, 58.7, 144, 145, 199.5, 415/209.2, 116
See application file for complete search history.

(56) References Cited

U.S. PATENT DOCUMENTS

| | | | | |
|---|---|---|---|---|
| 2,712,727 | A * | 7/1955 | Morley et al. | 60/39.093 |
| 2,905,434 | A * | 9/1959 | Hertl | 415/209.2 |
| 3,429,557 | A * | 2/1969 | Brandon et al. | 415/58.7 |
| 4,329,114 | A * | 5/1982 | Johnston et al. | 415/145 |
| 4,798,047 | A * | 1/1989 | Geary | 60/39.092 |
| 5,160,241 | A * | 11/1992 | Glynn | 415/175 |
| 6,161,839 | A * | 12/2000 | Walton et al. | 277/590 |
| 6,238,180 | B1 * | 5/2001 | Magoshi et al. | 415/168.4 |
| 7,407,370 | B2 * | 8/2008 | Bracken et al. | 415/199.5 |

FOREIGN PATENT DOCUMENTS

| | | |
|---|---|---|
| EP | 1403486 A2 | 3/2004 |
| FR | 2534982 A1 | 4/1984 |
| FR | 2925108 A1 | 6/2009 |

OTHER PUBLICATIONS

GB Search Report issued from corresponding GB Application No. 1021166.2 on Apr. 6, 2011.

* cited by examiner

*Primary Examiner* — Edward Look
*Assistant Examiner* — Aaron R Eastman
(74) *Attorney, Agent, or Firm* — Mark E. Henderson; Ernest G. Cusick; Frank A. Landgraff

(57) ABSTRACT

A shell structure for a turbine engine that includes a plurality of diaphragms, wherein each diaphragm comprises: an annularly formed support structure that positions and secures a row of circumferentially spaced stator blades, and wherein the plurality of diaphragms are configured and axially stacked such that each diaphragm abuts the diaphragm that is positioned directly upstream from it and the diaphragm that is positioned directly downstream from it such that a first shell structure is formed; a second shell structure disposed outboard of the first shell structure; and an intermediate chamber defined between an outboard face of the first shell structure and an inboard face of the second shell structure; wherein: a downstream end and an upstream end of the first shell structure define the axial length of the first shell structure; one or more downstream radial ports are defined at the approximate axial position of the downstream end of the first shell structure, each downstream radial port fluidly connecting the intermediate chamber to the main flow path of the turbine engine; and between the axial position of the downstream axial ports and the axial position of the upstream end of the first shell structure, the first shell structure is configured such that the intermediate chamber is substantially sealed from the main flow path.

22 Claims, 5 Drawing Sheets

DIAPHRAGM SHELL STRUCTURES FOR TURBINE ENGINES

BACKGROUND OF THE INVENTION

The present application relates generally to systems, and apparatus for improving the efficiency and operation of turbine engines, which, as used here and unless specifically stated otherwise, is meant to include all types of turbine or rotary engines, including steam turbine engines, combustion turbine engines, aircraft engines, power generation engines, and others. More specifically, but not by way of limitation, the present application relates to systems, and apparatus pertaining to turbine engine diaphragms and shells.

Turbine engines, such as steam turbines or gas turbines, typically include multiple turbine stages with each stage including a pair of interspersed stator rings and rotors. The stator rings (diaphragms) include nozzles or stator airfoils, and the rotors include buckets or rotating airfoils. To rotate the rotor, the nozzles direct high pressure and high temperature fluid onto the buckets in a direction that causes the buckets to rotate with a speed proportional to the fluid pressure.

To support the diaphragms and for maximum fluid utilization, the typical turbine engine includes one or more outer shells or casings. The outer shell isolates the working fluid from the ambient conditions outside the turbine engine, and also supports and provides alignment to the diaphragms. As the shell structures are constantly exposed to high pressures and temperatures, these structures are typically made from good quality and high-grade alloy metals that can withstand high pressures and temperatures; the higher the fluid's working pressure and temperature, the thicker the shell structure, and the better the metal quality. So, for very high pressure and temperature applications, turbine engines include three or more concentric shell structures. Each shell structure provides a layer of isolation from the temperature and pressure inboard of that shell, thereby splitting up the pressure and temperature change. As the inner most shell structure is subjected to the highest temperatures and pressures, this shell structure is the thickest and made from very expensive high-alloy steel; the outer shells, however, are exposed to intermediate pressures and temperatures, and therefore these structures are relatively thinner and made from lighter metals.

To reduce costs, attempts have been made to remove one or more shell structures. One such attempt removes the inner shell, leaving only the outer shell both to support the diaphragm and to contain the pressure and temperature within the turbine engine. That structure, however, provides only limited utility in high temperature and pressure applications, as the outer shell cannot, by itself, contain the high fluid pressure and temperature. Further, as only one shell structure is utilized the shell is thicker as compared to the outer shells utilized in three shell structures. The shell is cast from very expensive high-alloy steel, which again results in very expensive designs.

As a result, there remains a need for innovative approaches to more efficient and cost effective shell structures and diaphragms for turbine engines.

BRIEF DESCRIPTION OF THE INVENTION

The present application thus describes a shell structure for a turbine engine that includes a plurality of diaphragms, wherein each diaphragm comprises an annularly formed support structure that positions and secures a row of circumferentially spaced stator blades in a manner such that the stator blades deliver a working fluid flowing through a main flow path to a row of circumferentially spaced rotor blades in a manner consistent with efficient turbine engine operation, and wherein the plurality of diaphragms are configured and axially stacked such that each diaphragm abuts the diaphragm that is positioned directly upstream, if present, from and the diaphragm that is positioned directly downstream, if present, from it such that a first shell structure is formed; a second shell structure disposed outboard of the first shell structure, the second shell structure comprises a cylindrically formed rigid structure that is in proximity to and surrounds the first shell structure; and an intermediate chamber defined between an outboard face of the first shell structure and an inboard face of the second shell structure; wherein: a downstream end and an upstream end of the first shell structure define the axial length of the first shell structure; one or more downstream radial ports are defined at the approximate axial position of the downstream end of the first shell structure, each downstream radial port fluidly connecting the intermediate chamber to the main flow path of the turbine engine; and between the axial position of the downstream axial ports and the axial position of the upstream end of the first shell structure, the first shell structure is configured such that the intermediate chamber is substantially sealed from the main flow path.

The application further describes a shell structure for a steam turbine, the shell structure comprising: a plurality of diaphragms, wherein each diaphragm comprises an annularly formed support structure that positions and secures a row of circumferentially spaced stator blades in a manner such that the stator blades deliver a working fluid flowing through a main flow path to a row of circumferentially spaced rotor blades in a manner consistent with efficient turbine engine operation, and wherein the plurality of diaphragms are configured and axially stacked such that each diaphragm abuts the diaphragm that is positioned directly upstream, if present, from and the diaphragm that is positioned directly downstream, if present, from it such that a first shell structure is formed; a second shell structure disposed outboard of the first shell structure, the second shell structure comprises a cylindrically formed rigid structure that is in proximity to and surrounds the first shell structure; and an intermediate chamber defined between an outboard face of the first shell structure and an inboard face of the second shell structure; wherein: a downstream end and an upstream end of the first shell structure define the axial length of the first shell structure; the intermediate chamber and the second shell structure are substantially sealed at the upstream end of the shell structure to isolate the shell structure from temperature and pressure conditions further upstream of the shell structure; and between the downstream end and the upstream end of the first shell structure, the first shell structure is configured such that the intermediate chamber is substantially sealed from the main flow path.

These and other features of the present application will become apparent upon review of the following detailed description of the preferred embodiments when taken in conjunction with the drawings and the appended claims.

BRIEF DESCRIPTION OF THE DRAWINGS

These and other features of this application will be more completely understood and appreciated by careful study of the following more detailed description of exemplary embodiments of the invention taken in conjunction with the accompanying drawings, in which.

DETAILED DESCRIPTION OF THE INVENTION

Figure 1:
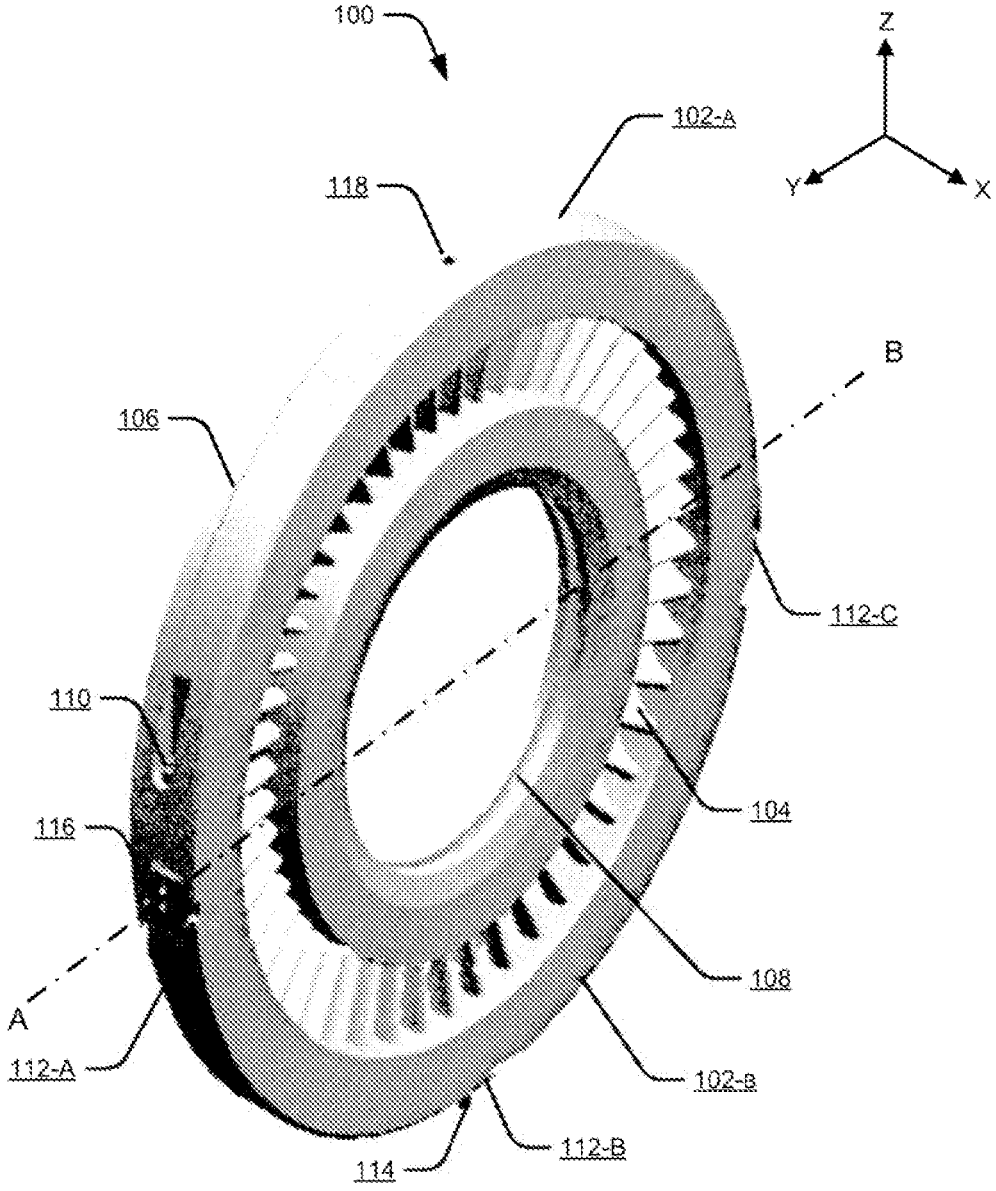
FIG. 1 (PRIOR ART)
FIG. 1 is an isometric view of a conventional diaphragm.

Embodiments of the present invention describe a turbine shell structure composed of a diaphragm shell and an outer shell. The diaphragm shell, which includes multiple axially abutting diaphragms, may be substantially sealed to prevent steam or fluid leakage from within the diaphragm shell structure, thereby eliminating the inner shell requirement. To this end, the diaphragm shell may include novel sealing devices that ensure sufficient isolation of the working fluid from the outer shell. Sealing reduces the outer shell thickness and facilitates usage of less expensive metals to fabricate the outer shells. Absence of an inner shell implies that the outer shell can be located closer to the diaphragms, which reduces the outer shell radius, and thereby decreases the amount of material employed to fabricate the outer shell. In this manner, low-cost and efficient turbine engines can be manufactured.

In some embodiments, an annulus formed between the diaphragm shell and the outer shell may not be sealed at the downstream end; in such embodiments, fluid from downstream stages can cool this annulus. Cooling the annulus further decreases the outer shell's thickness requirement, as the outer shell is exposed to lower temperatures. Alternatively, for regenerative-Rankine cycle turbines, the annulus can be sealed and the fluid, such as steam or gas can be extracted from any turbine stage through the sealed annulus. These and other embodiments will be described in detail with reference to the Figures.

To describe clearly the invention of the current application, it may be necessary to select terminology that refers to and describes certain machine components or parts of a turbine engine. Whenever possible, common industry terminology will be used and employed in a manner consistent with its accepted meaning. However, it is intended that any such terminology be given a broad meaning and not narrowly construed such that the meaning intended herein and the scope of the appended claims is unreasonably restricted. Those of ordinary skill in the art will appreciate that often certain components may be referred to with several different names. In addition, what may be described herein as a single part may include and be referenced in another context as consisting of several component parts, or, what may be described herein as including multiple component parts may be fashioned into and, in some cases, referred to as a single part. As such, in understanding the scope of the invention described herein, attention should not only be paid to the terminology and description provided, but also to the structure, configuration, function, and/or usage of the component as described herein.

In addition, several descriptive terms may be used herein. The meaning for these terms shall include the following definitions. The term "rotor blade," without further specificity, is a reference to the rotating blades of either the compressor or the turbine, which include both compressor rotor blades and turbine rotor blades. The term "stator blade," without further specificity, is a reference to the stationary blades of either the compressor or the turbine, which include both compressor stator blades and turbine stator blades. The term "blades" will be used herein to refer to either type of blade. Thus, without further specificity, the term "blades" is inclusive to all type of turbine blades, including compressor rotor blades, compressor stator blades, turbine rotor blades, and turbine stator blades.

Further, as used herein, "downstream" and "upstream" are terms that indicate a direction relative to the flow of working fluid through the turbine. As such, the term "downstream" means the direction of the flow, and the term "upstream" means in the opposite direction of the flow through the turbine. Related to these terms, the terms "aft" and/or "trailing edge" refer to the downstream direction, the downstream end and/or in the direction of the downstream end of the component being described. In addition, the terms "forward" or "leading edge" refer to the upstream direction, the upstream end and/or in the direction of the upstream end of the component being described. The term "radial" refers to movement or position perpendicular to an axis. It is often required to describe parts that are at differing radial positions with regard to an axis. In this case, if a first component resides closer to the axis than a second component, it may be stated herein that the first component is "inboard" or "radially inward" of the second component. If, on the other hand, the first component resides further from the axis than the second component, it may be stated herein that the first component is "outboard" or "radially outward" of the second component. The term "axial" refers to movement or position parallel to an axis. Moreover, the term "circumferential" refers to movement or position around an axis.

Referring now to the figures, it will be recognized by those in the art that the exemplary embodiments depicted and described herein all deal with steam turbines. It will also be recognized, however, that the exemplary embodiments are selected only to illustrate one application of the principles set out in the present disclosure. Those of skill in the art will be able to employ those principles across the range of various forms of turbine engines, as described above. As pointed out below, the invention set out in the present disclosure is set out solely in the claims, and none of the following discussion should be seen as limiting that scope.

FIG. 1 is a perspective view of a conventional turbine engine diaphragm 100, composed of a pair of semi-annular diaphragm ring segments 102-A and 102-B (hereafter referred to as diaphragm segments 102) joined at a horizontal split or joint surfaces (line AB). Each diaphragm segment 102 supports a semi-annular row of radially spaced airfoils 104 between a diaphragm ring 106 and diaphragm web 108. The airfoils 104 increase the fluid velocity and alter the flow direction so that the fluid impinges on buckets, causing them to rotate. The diaphragm segments 102-A and 102-B are joined by suitable fasteners, such as with horizontal bolts 110. Typically, two horizontal bolts 110 are used—one for each diaphragm segment joint surface. Crush pins 112-A, 112-B, and 112-C (hereafter referred to as crush pins 112) along the diaphragm circumference form a close tolerance fit to prevent the diaphragm 100 from rattling. Typically, three crush pins 112 are employed, one at each diaphragm segment joint surface, and one at the diaphragm bottom. Other fastening devices known to those in the art may be employed to meet the requirement of particular implementations of the disclosure. It will be understood that the number of bolts and pins, and the type of bolts and pins utilized to join the diaphragm segments 102 may vary depending on the type of turbine engine.

During assembly, diaphragms, such as the diaphragm 100, are fixed into shells or casings (not illustrated). Centering pins 114 and support bars 116 facilitate this mounting. Centering pins 114, typically located at the diaphragm bottom, transversely align the diaphragm 100 in the shell, and support bars 116, typically present on the outboard face of the diaphragm 100, hold the diaphragm 100 within the shell/casing. These support bars 116 engage similar extensions present on the inboard face of the shell, locking the diaphragm 100 in place and providing vertical support and alignment. Further, a lifting provision 118 is provided on the diaphragm 100 to lift the diaphragm 100 in and out of the outer shell.

Figure 2:
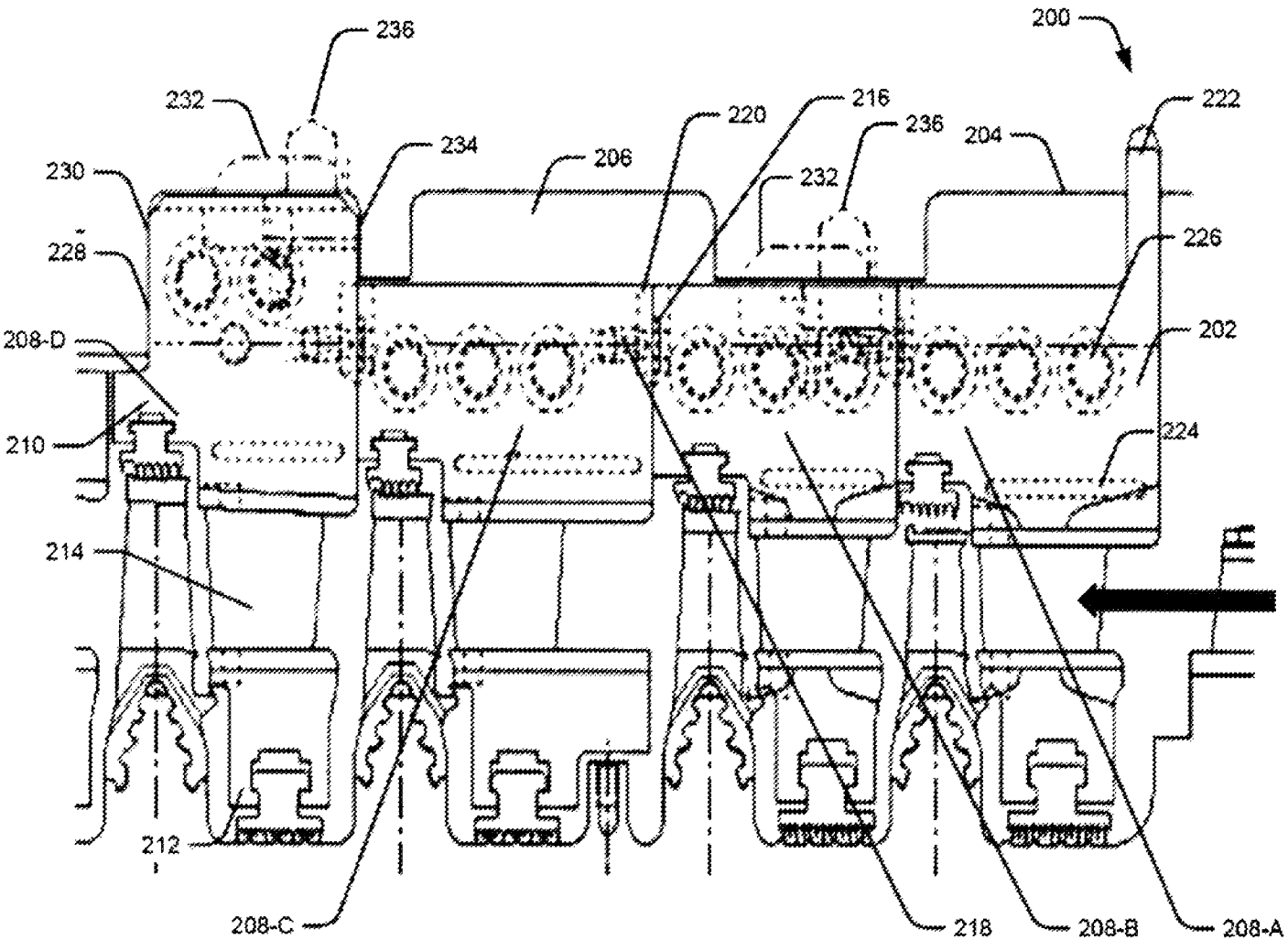
FIG. 2 is a partial elevation cut-away view of an exemplary turbine assembly accordingly to some embodiments of the present invention.
Figure 3:
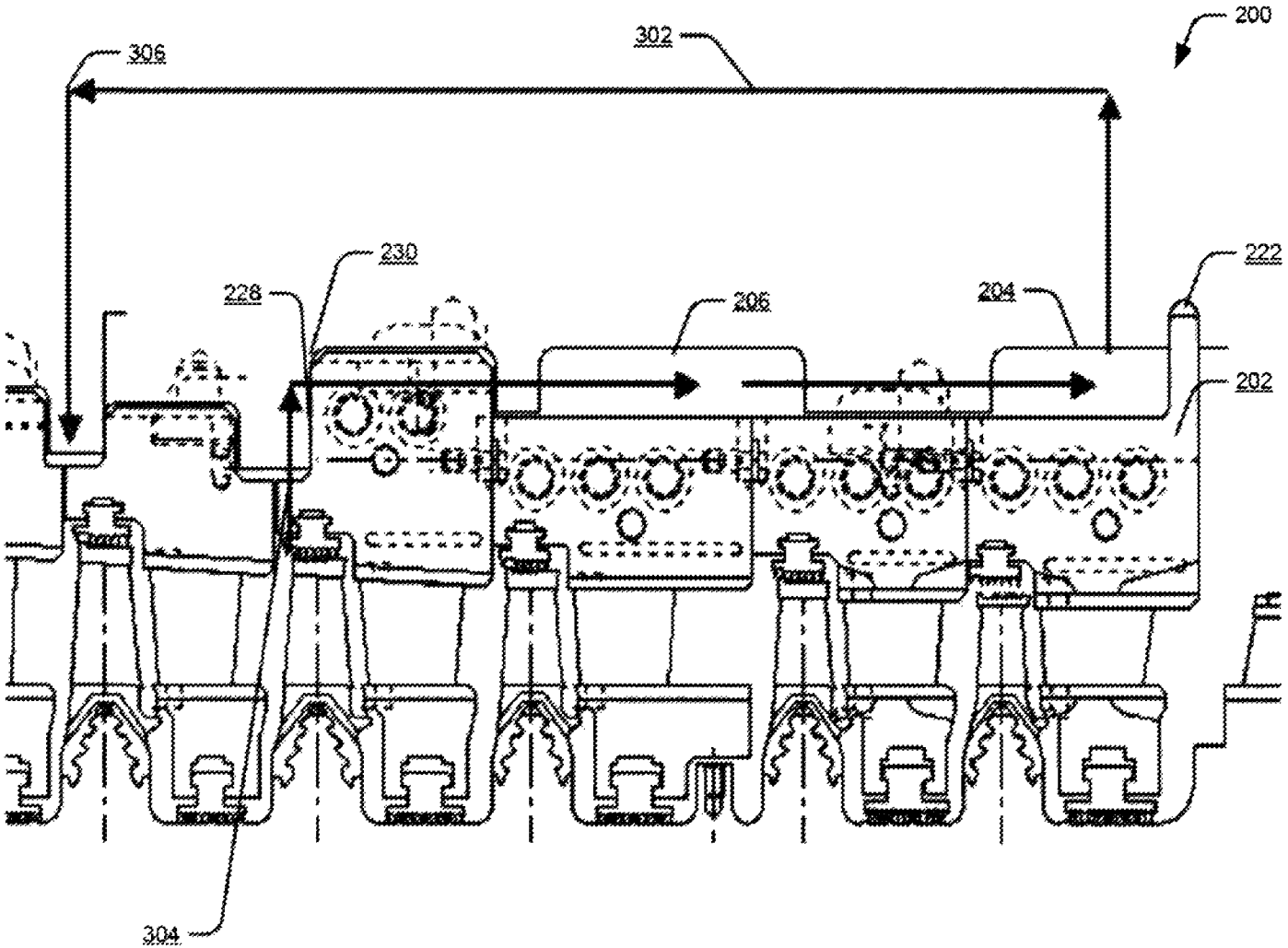
FIG. 3 is a partial elevation cut-away view of the exemplary turbine of FIG. 2, depicting annulus ventilation.
Figure 4:
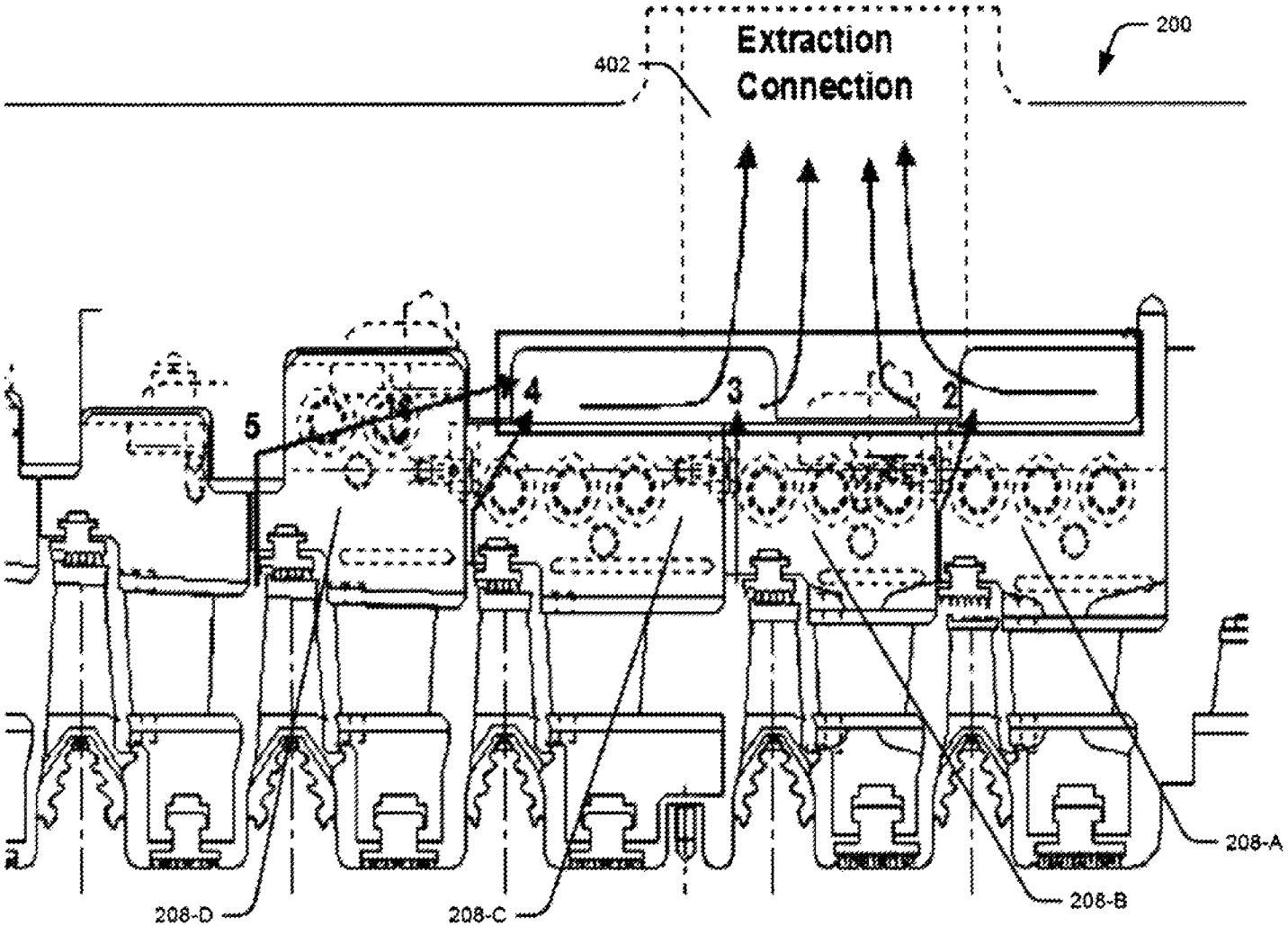
FIG. 4 is a partial elevation cut-away view of the exemplary turbine of FIG. 2, depicting steam extraction according to embodiments of the present invention.

FIG. 2 is a partial elevation cut-away view of a turbine assembly, schematically illustrating an exemplary turbine shell structure 200. FIGS. 2-4 depict a turbine assembly of a multiple stage high-pressure steam turbine, with the arrow illustrating the steam flow (downstream) direction. It will be appreciated, however, that the turbine shell structure 200 can be employed in various applications, such as gas turbines, nuclear turbines, fossil fuel turbines, high-pressure turbines, intermediate pressure turbine stages, or low-pressure turbine stages, without departing from the scope of the invention. A high-pressure steam turbine stage is illustrated here merely as an example to describe the various parts of the turbine shell structure 200 and not to dictate the scope of the present invention.

The turbine shell structure 200 includes a diaphragm shell 202, an outer shell 204 disposed outboard of the diaphragm shell 202, and an intermediate chamber 206 (interchangeably referred to as an annulus 206) formed between the outboard side of the diaphragm shell 202 and the inboard side of the outer shell 204. The outer shell 204 and the annulus 206 may extend approximately the full axial length of the diaphragm shell 202.

The outer shell 204 may be a rigid structure in proximity to and surrounding the diaphragm shell 202. Moreover, the outer shell 204 may make contact with the diaphragm shell 202 along at least a portion of the outboard face of the diaphragm shell 202. The outer shell 204 contains the high pressure and high temperature steam within the turbine. Therefore, the outer shell's diameter and thickness vary depending on the application; for example, in low-pressure conditions, the outer shell's thickness is relatively less than the thickness required for higher-pressure situations. Further, the outer shell 204 may be integrally formed of a metal. The material used varies depending on the turbine application, the pressure and temperature conditions in the turbine, and so on. Typical materials include carbon steel, chromium-molybdenum alloy steel, chromium-molybdenum-vanadium alloy steel and high chromium content steel.

The annulus 206 includes a relatively narrow hollow space that may vary in radial width along the axial length of the diaphragm shell 202. In addition, outboard of the downstream diaphragm shell end, the annulus 206 may be in fluid communication with the annulus 206 outboard of the upstream diaphragm shell end.

The diaphragm shell 202 can include a number of multiple axially-abutting diaphragms, such as diaphragms 208-A, 208-B, 208-C, and 208-D (hereafter collectively referred to as diaphragms 208). For simplicity, FIG. 2 depicts four axially stacked diaphragms 208, it will be understood, however, that the number of diaphragms 208 may vary. Some implements may provide a structure incorporating three diaphragms 208; alternatively, the diaphragm shell 202 can include more than four diaphragms 208, and that number can be increase six or more diaphragms 208 in appropriate installations. Based on the disclosure set out herein, those in the art will be able to adapt the number of diaphragms to the needs of particular implementations. Depending on the application, the stages required, or the turbine type, the number of axially stacked diaphragms 208 in the diaphragm shell 202 can vary. Further, one or more diaphragm shells 202 can be axially disposed within the outer shell 204, depending on the number of stages required.

Each diaphragm 208 may include a diaphragm ring 210, a diaphragm web 212, and multiple circumferentially spaced nozzles or stator blades 214 supported between the diaphragm ring 210 and the diaphragm web 212. The abutting diaphragms 208 substantially seal the main flow path by forming a shell structure that may perform the function of a conventional inner shell.

Here, the diaphragms 208 are mechanically coupled. Other designs can achieve the functional equivalent of that arrangement by suitable coupling mechanisms. In one embodiment, diaphragms 208 may be coupled in pairs, for example, so that the first upstream diaphragm 208-A can be mechanically coupled to the adjacent downstream diaphragm 208-B. This diaphragm 208-B, in turn, can be mechanically coupled to the next downstream diaphragm 208-C, with this process repeating until all the diaphragms 208 are coupled. In an alternate embodiment, axial holes may be drilled through the diaphragms 208 and one or more rods may bolt all the diaphragms 208. For coupling pairs of diaphragm rings 210, any mechanical fitting can be employed. These fittings are widely known in the art and it will be understood that the fittings utilized do not dictate the scope of the present invention.

One exemplary coupling method is shown in FIG. 2. Here, rabbet joints 216 and stacking bolts 218 combine to join the diaphragm rings 210. Abutting diaphragm edges are structured to form the rabbet joint 216, with one diaphragm 208 including a groove and the other including an extension, which fit together. For example, diaphragm 208-A can include a groove while diaphragm 208-B can include an extension. A hole may be drilled through this rabbet joint 216, and the stacking bolt 218 may extend through the hole, sealing the rabbet joint 216. Alternatively, a hole can be drilled through the entire stack of diaphragms 208, and a single stacking bolt, such as the stacking bolt 218, can secure all the diaphragms 208. Each diaphragm pair further includes radial dowels 220; depending on the application, the number of radial dowels 220 can vary. In one embodiment, each diaphragm pair can include six radial dowels 220, three on the diaphragm 208 top half, and three on the bottom half. The radial dowels 220 provide circumferential diaphragm alignment and transfer the reactionary torque from the diaphragms 208 to the outer shell 204. Other embodiments can include more or fewer radial dowels 220, as known in the art. These radial dowels 220 are typically pins or metal blocks that fit into holes in the abutting portions of two diaphragms 208, partly in one diaphragm 208 and partly in the other, to align them with respect to each other.

The mechanically coupled diaphragms 208 may be substantially sealed to eliminate or reduce steam leakage from the main flow path into the annulus 206. Various sealing mechanisms may be employed to achieve this result; examples can include a barrier fit 222, one or more sealing key(s) 224, one or more horizontal bolt(s) 226, one or more axial support(s) 228, or an axial seal 230. The upstream end of the turbine shell structure 200 may be axially disposed adjacent the trailing edge of the turbine's first stage (not illustrated), which operates at the highest pressure and highest temperature in the steam turbine. The barrier fit 222 may circumferentially fit around the annulus 206 and the outer shell 204 at this upstream end to isolate the high pressure and high temperature steam upstream of the barrier fit 222, so that ambient conditions downstream of the barrier fit 222 can be controlled as desired. Controlling these conditions ensures that the outer shell 204 is not exposed to the relatively high first stage pressures and temperatures. The barrier fit 222 can be formed using a flexible, heat and pressure tolerant material to accommodate the differential axial expansions between the first stage upstream of the barrier fit 222 and the outer shell 204. Among the flexible materials employed to fabricate the barrier fit 222 are, carbon steel, chromium-molybdenum alloy steel, chromium-molybdenum-vanadium alloy steel, high chromium alloy steel, and nickel alloys.

The sealing key 224 can extend along each diaphragm's horizontal joint, thereby eliminating or minimizing leakage paths along mating faces of diaphragm segments. In one embodiment, the diaphragms 208 may be closely stacked so that the sealing keys 224 from each diaphragm 208 can be located as close to each other as possible. This arrangement provides effective sealing along the horizontal joints. Alternatively, the sealing key 224 can form a gapless seal along the horizontal joint of the diaphragms 208. To this end, retainer keys (not illustrated) may cover the gaps between the diaphragms 208, and the sealing key 224 can extend all along the horizontal joints. Sealing keys are adequately known in the art, and therefore, they will not be described in detail here.

The horizontal bolts 226, which may be provided along the diaphragm's horizontal joint, may also minimize leakage. Conventionally, one horizontal bolt is employed per diaphragm 208. The embodiments of the present invention, however, may utilize multiple horizontal bolts 226 per diaphragm 208. In one embodiment, the horizontal joints may be sealed using as many horizontal bolts 226 as can axially fit along the diaphragm's horizontal joint. Alternatively, a specified number of horizontal bolts 226 can be employed per diaphragm 208. Sealing keys 224 and horizontal bolts 226, collectively, eliminate or substantially reduce leakage into the annulus 206 through the horizontal joint.

In addition to horizontal seals (such as the sealing keys 224 and the horizontal bolts 226), the axial support 228 or the axial seal 230 may be employed to seal the annulus 206. Axial supports are conventionally employed in steam turbines and can be employed as well in other turbine applications. These supports provide fixtures to axially support the diaphragms 208. The axial support 228 provides a locational fit around the last downstream diaphragm, diaphragm 208-D, and does not extend circumferentially around the diaphragm 208-D; as a result, this support may be useful in certain single-flow engines in which steam is allowed to flow in the annulus 206. Alternatively, the axial seal 230 may be employed to seal the annulus 206 between the diaphragm shell's downstream end and the outer shell 204. The axial seal 230 is a circumferential seal that substantially seals the annulus 206. It will be understood that various other known seals can be employed to seal the annulus 206 without departing from the scope of the present invention.

The sealed diaphragm shell 202 restricts the high pressure and high temperature working steam within the steam flow path, thereby eliminating the need for an inner shell. Further, the axial seal 230 offers the advantage of sealing the annulus 206, thus controlling the temperature and pressure within the annulus 206. This measure allows fabrication of thinner and less costly outer shells, which in turn can reduce the turbine's cost considerably.

The diaphragm shell 202 may further include conventional bolts and supports to retain the diaphragms 208 in position within grooves in the outer shell 204. For example, in one embodiment, vertical supports 232 (support bars 116 of FIG. 1) may be provided along the circumference of the diaphragm rings 210. Each diaphragm ring 210 can include two vertical supports 232 (only one vertical support 232 is illustrated) to support the diaphragm shell 202 in the outer shell 204. In another embodiment, alternate diaphragm rings 210 may include vertical supports 232. Crush pins 234 may be employed, as well, to fix the diaphragm shell 202 and to preclude the diaphragms 208 from rattling. In one embodiment, three crush pins 234 are employed per diaphragm 208; these crush pins 234 are utilized in the diaphragm's lower half. In addition, one or more centering pins 236 may be circumferentially disposed at the bottom end of the diaphragms 208. As depicted in the figure, two centering pins 236—one at the bottom end of diaphragm 208-D and the other at the bottom end of diaphragm 208-B can be used. It will be understood, however, that the centering pins 236 may be disposed at the top end of the diaphragms instead, or that the centering pins 236 may be disposed on the diaphragms 208-A and 208-C or any other combination of diaphragms 208 without departing from the scope of the present invention. These centering pins 236 are relatively larger than conventional centering pins 114 and provide transverse alignment. It will be understood that other conventional bolts, fits, supports, or nuts may be employed to fix, support, align, or seal the diaphragm shell 202 and the outer shell 204. These tools are widely known in the art and require no further explanation here.

In certain extremely high-pressure situations, the turbine shell structure 200 may include a second outer shell (not illustrated) outboard of the outer shell 204 to split the pressure and temperature change. The second outer shell can have a cylindrical rigid structure in proximity to and surrounding the outer shell 204. It will be appreciated that the second outer shell's thickness and composition may vary depending on the pressure and temperature of the desired application.

The turbine shell structure 200 can be employed in high pressure and temperature applications ranging from about 1800 Psi to about 4500 Psi and 900° F. to about 1150° F., and preferably in applications ranging from about 2400 Psi to about 3500 Psi and 1000° F. to about 1100° F. In very high pressure and temperature applications, 3-wall structures are typically implemented, which include concentric rings of an outer shell, an inner shell, and a nozzle box. By implementing at least some of the teachings of the present invention, the inner shell can be eliminated, and the outer shell 204 can be disposed circumferentially closer to the diaphragm shell 202 as compared to the conventional 3-wall structures. This assembly produces a low-cost turbine structure, because the inner shell is eliminated and the outer shell 204 diameter is decreased (which reduces the material requirement). Further, as the outer shell 204 is subjected to controlled temperature and pressure conditions, less expensive materials can be employed for fabricating that component.

In relatively lower pressure and temperature applications, one-wall structures are typically implemented, which include only an outer shell. In these applications, a conventional outer shell is subjected to the stage pressure and temperature. Therefore, the outer shell thickness is governed by stage conditions, which implies that the outer shell is thicker in the upstream stages than in the downstream stages. The sealed diaphragm shell 202 according to some embodiments of the present invention, however, ensures either that the outer shell 204 is substantially shielded from any stage conditions (when the axial seal 230 is used), or exposed to only the relatively low final stage conditions (when the axial support 228 is used). This property of the diaphragm shell 202 facilitates reduction in outer shell thickness and utilization of less expensive material to manufacture the outer shell 204, thereby reducing turbine costs.

FIG. 3 illustrates another embodiment of the present invention, in a partial elevation cut-away view of the turbine shell structure 200 illustrating annulus pressurization & ventilation. Pressurization relates to tailoring the pressure in the annulus to minimize pressure drop across the membranes, while ventilation relates to selecting the "optimum" annulus temperature depending on the membrane material utilized. In this embodiment, the axial support 228 is utilized instead of the axial seal 230. As a result, the annulus 206 is not sealed, but rather is exposed to the final stage's pressure. Lower temperature and pressure steam from the main flow path may leak into the annulus 206 from the final downstream stage (diaphragm 208-D), and this steam cools the annulus 206 from the downstream end to the upstream end, adjacent to the barrier fit 222. From the upstream end, the steam may exit the outer shell 204 through external pipes 302, and these pipes can reinsert the steam at any stage of the diaphragm shell 202. Alternatively, instead of reinserting the steam, the external pipes 302 may direct steam from the upstream end to a condenser, a feed water heater, or any similar external device known in the art.

In other embodiments, steam from any intermediate stage may be utilized, instead, to cool the annulus 206. Each turbine stage operates at different ambient temperatures and pressures, and generally, the steam pressure and temperature both drop as the steam travels downstream. Depending on the required pressure drop, an appropriate stage can be selected to cool or pressurize the annulus 206. To this end, the axial seal 230 can be utilized instead of the axial support 228, and the entire annulus 206 can be sealed. Then a radial port 304 may be drilled in the appropriate stage, and steam from that stage can be utilized to cool or pressurize the annulus 206. Again, external pipes 302 are utilized to circulate the steam from the annulus 206 back into the diaphragm shell 202. The external pipe 302 may include a valve 306 that re-inserts steam at a required pressure in the diaphragm shell 202. Depending on the pressure and the temperature of the circulated steam, radial ports 304 are drilled for re-inserting the steam at the appropriate stage. For example, but not by way of limitation, if the working steam from stage 3 cools the annulus 206, then after circulation, the steam can re-enter the main flowpath either through stages 4 or 5, depending on the temperature and pressure of the re-inserted steam.

Because steam is extracted from a relatively cool stage, the ventilation cools the outer shell 204 to the temperature of that stage. That cooling action permits reduction of the outer shell 204 wall thickness, bolting, and shell requirements, reducing the outer shell's cost.

FIG. 4 illustrates another embodiment of the turbine shell structure 200. The figure is a partial elevation cut-away view schematically illustrating an extraction arrangement to extract steam from the diaphragm shell 202. In certain applications, such as extraction turbines and regenerative-Rankine turbines, steam is withdrawn from one or more stages, at one or more pressures, for various applications, such as heating, plant process, or feed-water heater needs.

This disclosure describes two steam extraction embodiments. In one embodiment, steam may be extracted from any stage marked 2, 3, or 4; and in the second embodiment, steam can be extracted from the stage marked 5. In the first embodiment, the axial seal 230 seals the annulus 206. Depending on the required temperature and pressure, radial ports 304 can be drilled in the direction of the arrows, which permit steam to enter the annulus 206 from that stage. An extraction connection 402 draws the steam from the annulus 206 and provides the steam to feed-water heaters (not shown). The extraction connection 402 can include typical extraction ports, pipes, or tubes, which extend from the annulus 206 to the outboard face of the outer shell 204 and from the outboard face of the outer shell 204 to an extraction assembly. A typical extraction assembly may be employed beyond the extraction connection 402.

For the second embodiment, the axial support 228 is utilized. Here, steam from the final downstream stage enters the annulus 206. The extraction connection 402 extracts this steam from the annulus 206 through the outer shell 204. Using the turbine shell structure 200 described in this disclosure, steam can be extracted from any stage by easily varying the annulus seal from the axial seal 230 to the axial support 228.

Figure 5:
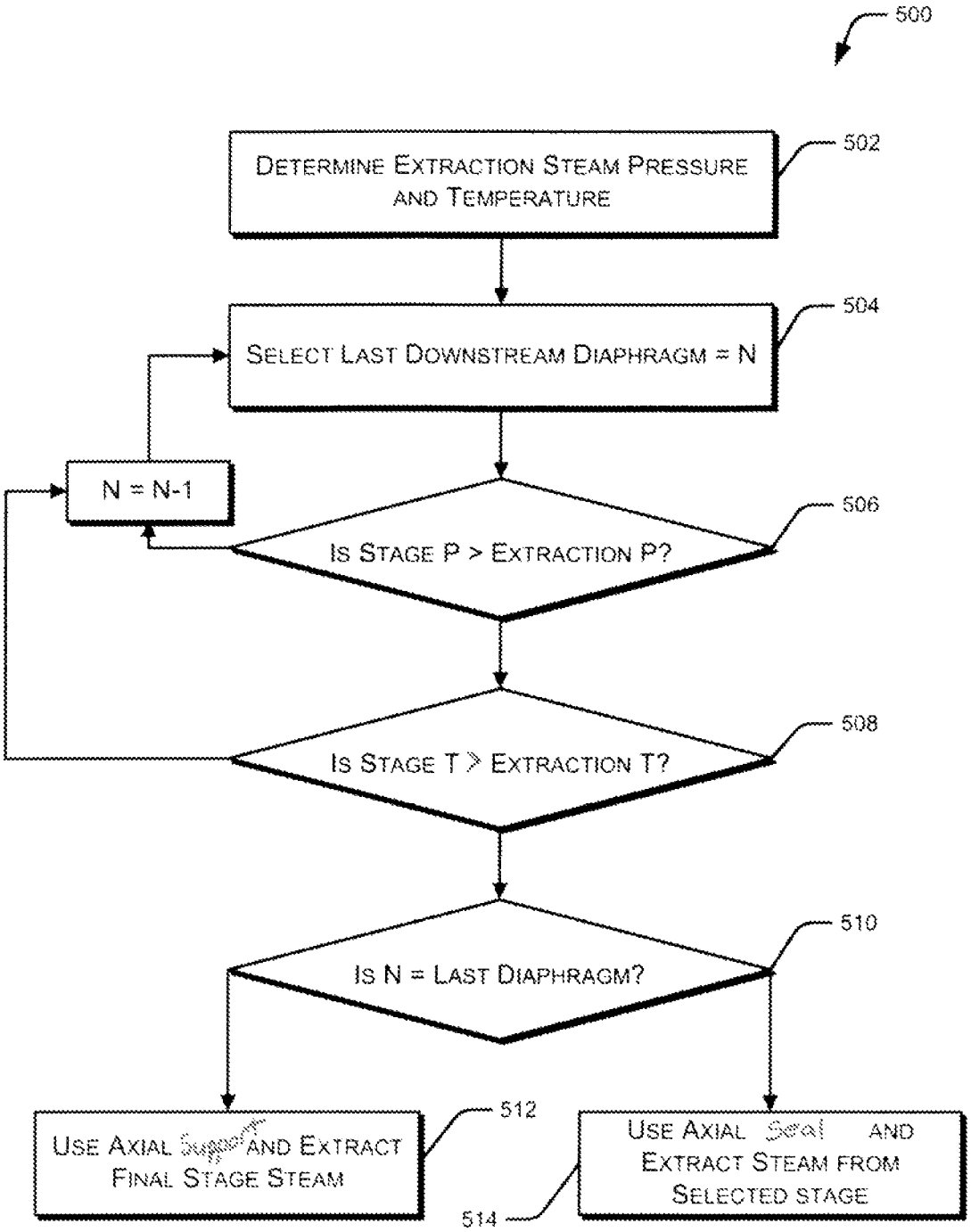
FIG. 5 is a flowchart illustrating an exemplary method for selecting a radial port for steam extraction.

FIG. 5 is a flowchart illustrating an exemplary method for selecting an appropriate radial port for steam extraction. The method may include determining the required steam pressure and temperature for extraction at step 502. Here, based on the application, the extraction pressure and temperature required may vary. For example, for feed water heating applications, higher temperature and pressure steam may be used, while for cooling applications, it may be more desirable to use lower temperature and pressure steam.

At step 504, the last downstream diaphragm 208-D may be selected. The next step, step 506, may compare the stage pressure with the extraction pressure to determine the most appropriate diaphragm stage. It will be understood that to extract steam from the turbine shell structure 200 the stage pressure should be greater than the extraction pressure. Further, it will be understood that the turbine shell structure 200 can also facilitate steam admission if the pressure of the steam is less than the admission pressure. The comparison starts from the last downstream diaphragm 208-D. If the pressure at this diaphragm 208-D is lesser than the extraction pressure required, the method 500 can move to the next upstream diaphragm (diaphragm 208-C) and compare that stage's pressure with the extraction pressure. This process continues until the method 500 determines upon comparison that a certain stage's pressure is greater than the extraction pressure required.

Step 508 may compare extraction temperatures with the temperatures at each stage to determine the most appropriate stage. For feed water heating application, the stage is selected such that the stage temperature is greater than the extraction temperature; while, for cooling applications, the stage is selected such that the stage temperature is less than the extraction temperature. In one embodiment, (in a feed water heating application) the method 500 starts comparing from the diaphragm 208 selected by step 504. If that diaphragm stage's temperature is greater than the extraction temperature required, the method 500 proceeds to step 510. Alternatively, the method 500 returns to step 506 and determines the pressure and temperature of the next upstream diaphragm 208. This process continues, until the method determines the most appropriate stage.

At step 510, a determination may be made whether the most appropriate diaphragm 208 is the last downstream diaphragm 208-D. If the most appropriate stage is the last downstream diaphragm 208-D, the process may move to step 512 and the axial support 228 can be utilized, which allows steam from the final stage to enter the annulus 206. The extraction connection 402 delivers the final stage steam to an external device, such as the feed-water heater (not shown). If, on the other hand, any other stage is selected as the most appropriate stage, the method 500 may proceed to step 514, and the axial seal 230 can be utilized. At this step, the annulus 206 is substantially sealed and a radial port, such as radial port 304 may be drilled in the most appropriate diaphragm stage. Steam from this stage is allowed to escape into the annulus 206 and exit the steam turbine through the extraction connection 402.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, all of the possible iterations are not provided or discussed in detail, though all combinations and possible embodiments embraced by the several claims below or otherwise are intended to be part of the instant application. In addition, as indicated by the description above, setting out several exemplary embodiments of the invention, those skilled in the art will perceive improvements, changes, and modifications. Such improvements, changes, and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A shell structure for a turbine engine, the shell structure comprising:

a plurality of diaphragms, wherein each diaphragm comprises an annularly formed support structure that positions and secures a row of circumferentially spaced stator blades in a manner such that the stator blades deliver a working fluid flowing through a main flow path to a row of circumferentially spaced rotor blades in a manner consistent with efficient turbine engine operation, and wherein the plurality of diaphragms are configured and axially stacked such that each diaphragm abuts the diaphragm that is positioned directly upstream, if present, from it and the diaphragm that is positioned directly downstream, if present, from it such that a first shell structure is formed;

a second shell structure disposed outboard of the first shell structure, the second shell structure comprises a cylindrically formed rigid structure that is in proximity to and surrounds the first shell structure; and an intermediate chamber defined between an outboard face of the first shell structure and an inboard face of the second shell structure;

wherein:

a downstream end and an upstream end of the first shell structure define the axial length of the first shell structure;

one or more downstream radial ports are defined at the approximate axial position of the downstream end of the first shell structure, each downstream radial port fluidly connecting the intermediate chamber to the main flow path of the turbine engine;

between the axial position of the downstream radial ports and the axial position of the upstream end of the first shell structure, the first shell structure is configured such that the intermediate chamber is substantially sealed from the main flow path;

the first shell structure and the second shell structure are configured to substantially seal the intermediate chamber at the upstream end of the first shell structure; and the seal comprises a circumferentially extending radial flange formed in the diaphragm ring that is configured to engage a circumferentially extending radial groove formed in the second shell structure.

2. The turbine shell structure according to claim 1, wherein the first shell structure and downstream radial ports are configured such that the pressure level within the intermediate chamber corresponds to the pressure level of the main flow path at the axial position of the downstream radial ports.

3. The turbine shell structure according to claim 1, wherein:

the first shell structure comprises a shell structure pressure rating, the shell structure pressure rating comprising an approximate pressure level across the shell structure at which the shell structure is constructed to operate; and the first shell structure is configured to include a shell structure pressure rating that corresponds to the approximate pressure drop in the main flow path from the axial location of the upstream end of the first shell structure to the axial location of the downstream radial ports of the first shell structure.

4. The turbine shell structure according to claim 1, wherein the turbine engine comprises a steam turbine engine.

5. The turbine shell structure according to claim 1, wherein the steam turbine engine is configured to operate at pressures greater than 1800 psi and temperatures greater than 900° F.

6. The turbine shell structure according to claim 1, wherein the steam turbine engine is configured to operate at pressures greater than 4499 psi and temperatures greater than 1149° F.

7. The turbine shell structure according to claim 1, wherein the plurality of axially stacked diaphragm rings comprises at least 3 diaphragms.

8. The turbine shell structure according to claim 1, wherein the plurality of axially stacked diaphragm rings comprises at least 4 diaphragms.

9. The turbine shell structure according to claim 1, wherein the plurality of axially stacked diaphragms comprises at least 6 diaphragms.

10. The turbine shell structure according to claim 1, wherein the second shell structure is integrally formed.

11. The turbine shell structure according to claim 1, wherein the second shell structure makes contact with each of the diaphragm rings of the first shell structure along at least a portion of the outboard face of the diaphragm rings.

12. The turbine shell structure according to claim 1, wherein the intermediate chamber comprises a radially narrow hollow space that varies in radial width along its axial length.

13. The turbine shell structure according to claim 12, wherein the intermediate chamber extends substantially the full axial length of the first shell structure.

14. The turbine shell structure according to claim 13, wherein the intermediate chamber is configured such that the space defined within the intermediate chamber outboard of the diaphragm disposed at the downstream end of the first shell structure is in fluid communication to the space defined outboard of the diaphragm disposed at the upstream end of the first shell structure.

15. The turbine shell structure according to claim 1, further comprising a third shell structure;

wherein the third shell structure comprises a cylindrically formed rigid structure that is in proximity to and surrounds the second shell structure.

16. The turbine shell structure according to claim 1, further comprising a return passage;

wherein the return passage fluidly connects the intermediate chamber to the main flowpath at a return outlet, and wherein the axial position of the return outlet is downstream of the axial position of the one or more downstream radial ports.

17. The turbine shell structure according to claim 16, wherein the downstream radial ports, the intermediate chamber, the outlet, the return passage, and the return outlet are configured such that, in operation, the pressure differential of the main workflow between the axial position of the radial ports and the axial position of the return outlet causes the working fluid to circulate from the radial ports to the intermediate chamber to the outlet to the return passage and to the return outlet in a desired manner.

18. The turbine shell structure according to claim 1, wherein the plurality of diaphragm rings is secured to each other via at least one of a plurality of circumferentially spaced stacking bolts and a plurality of radial dowels.

19. The turbine shell structure according to claim 1, wherein a plurality of vertical supports rigidly secure at least a plurality of the diaphragm rings of the first shell structure to the second shell structure.

20. The turbine shell structure according to claim 1, further comprising a downstream radial ledge formed in the second shell structure that is configured to axially support at least one of the diaphragms of the first shell structure.

21. The turbine shell structure according to claim 20, wherein:

the downstream radial ledge comprises a radial step formed in an inner wall of the second shell structure;

the downstream radial ledge is configured to overlap radially with the diaphragm of the first shell structure that resides directly upstream of the downstream radial ledge; and the radial overlap is configured such that, once the diaphragm abuts the downstream radial ledge, the downstream radial step substantially prevents downstream axial displacement of the diaphragm during operation.

22. The turbine shell structure according to claim 1, wherein the radial flange comprises a flexible material such that, in operation, the radial flange is configured to accommodate different thermal axial expansion rates that may exist between the first shell structure and the second shell structure.

* * * * *